US008002116B1

(12) United States Patent
Cato

(10) Patent No.: US 8,002,116 B1
(45) Date of Patent: Aug. 23, 2011

(54) VIBRATING STACKABLE FINE INDUSTRIAL MINERAL HIGH SPEED SCREENING UNIT

(76) Inventor: James N. Cato, Brenham, TX (US)

( * ) Notice: Subject to any disclaimer, the term of this patent is extended or adjusted under 35 U.S.C. 154(b) by 28 days.

(21) Appl. No.: 12/576,403

(22) Filed: Oct. 9, 2009

(51) Int. Cl.
*B07B 1/28* (2006.01)

(52) U.S. Cl. ..... 209/319; 209/315; 209/318; 209/365.2; 209/365.3

(58) Field of Classification Search ..... 209/315, 209/318, 319, 365.2, 365.3
See application file for complete search history.

(56) References Cited

U.S. PATENT DOCUMENTS

| | | | | |
|---|---|---|---|---|
| 265,398 | A * | 10/1882 | Esmond | 209/318 |
| 1,500,090 | A * | 7/1924 | Sturtevant | 209/365.2 |
| 1,639,678 | A * | 8/1927 | Woodward | 209/405 |
| 4,003,831 | A * | 1/1977 | Tishkov et al. | 209/315 |
| 4,642,180 | A * | 2/1987 | Kaufman | 209/44 |
| 5,232,098 | A * | 8/1993 | St-Pierre et al. | 209/240 |
| 5,341,939 | A * | 8/1994 | Aitchison et al. | 209/319 |
| 6,575,304 | B2 * | 6/2003 | Cudahy | 209/365.3 |
| 7,644,824 | B2 * | 1/2010 | Hollyfield et al. | 209/405 |
| 2009/0206011 | A1 * | 8/2009 | Cudahy | 209/365.3 |
| 2010/0038291 | A1 * | 2/2010 | Sauser | 209/341 |

* cited by examiner

*Primary Examiner* — Terrell Matthews
(74) *Attorney, Agent, or Firm* — Buskop Law Group, PC; Wendy Buskop

(57) ABSTRACT

A single or multi-deck vibrating stackable material screening unit having a plurality of screen frames each with a plurality of compression cross members, a plurality of tension cross members, two air manifold cross members, a plurality of air operated isolation mounts, a plurality of mounting blocks, fastened to an air operated isolation mount; a vibrating screen tensioner supporting a vibrator motor and a body over and connected to the mounting blocks over all compression cross members wherein the body has a length longer than its width and the length extends from the feed inlet to the discharge spout, two relocatable removable detachable lifting mechanisms, two clevis assemblies connecting to at least two tang assemblies, and particulate falls through the screen cloth from the first screen frame to the second screen frame, while discharging a predetermined diameter particulate.

41 Claims, 11 Drawing Sheets

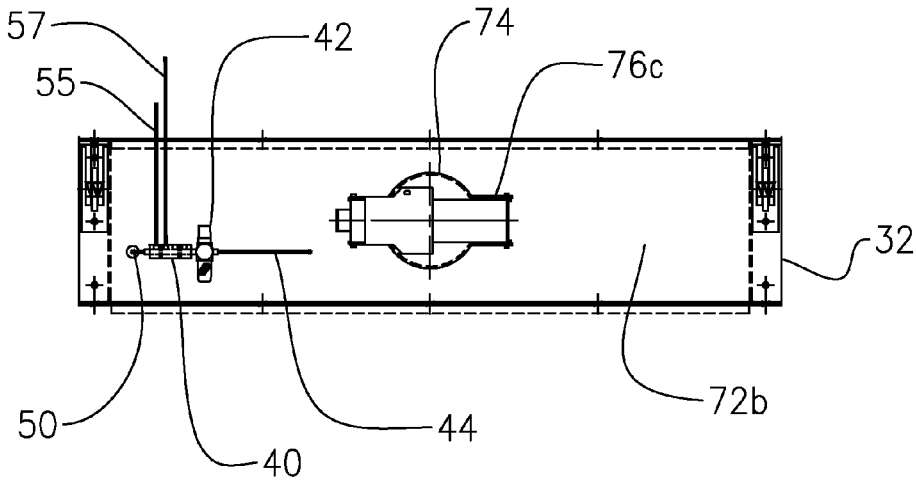
FIGURE 4
FIGURE 5
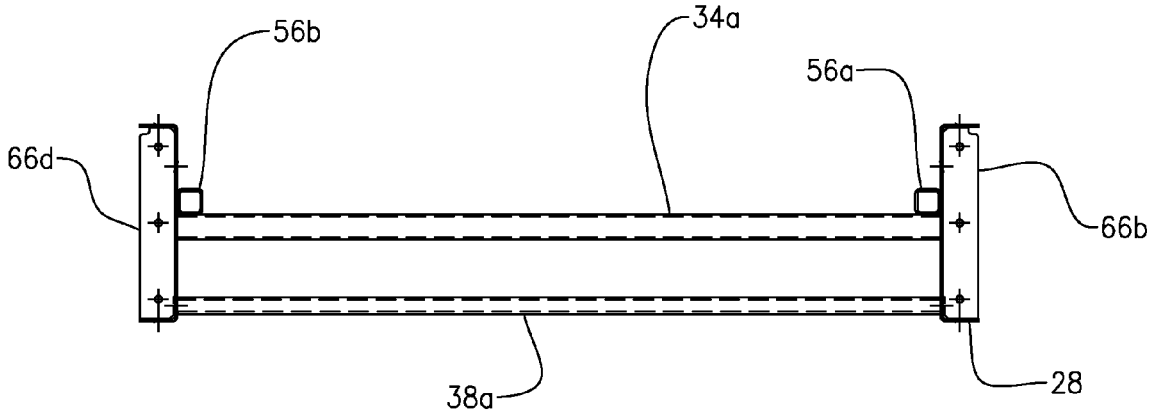

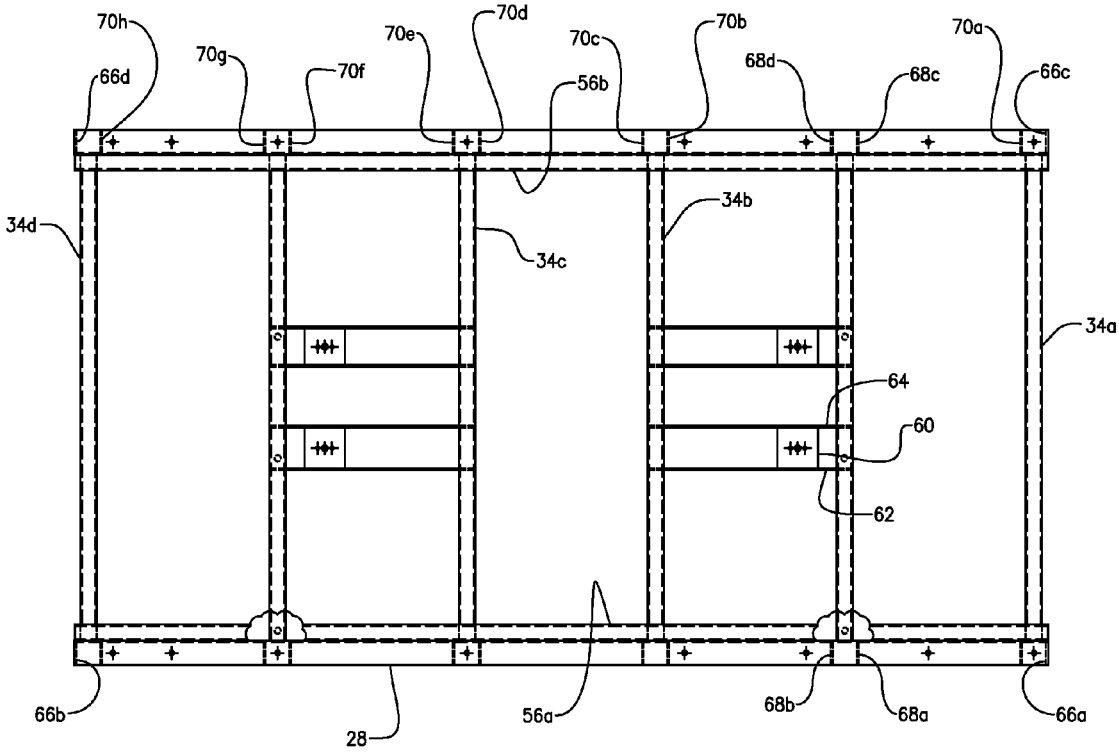
FIGURE 6A
FIGURE 6B
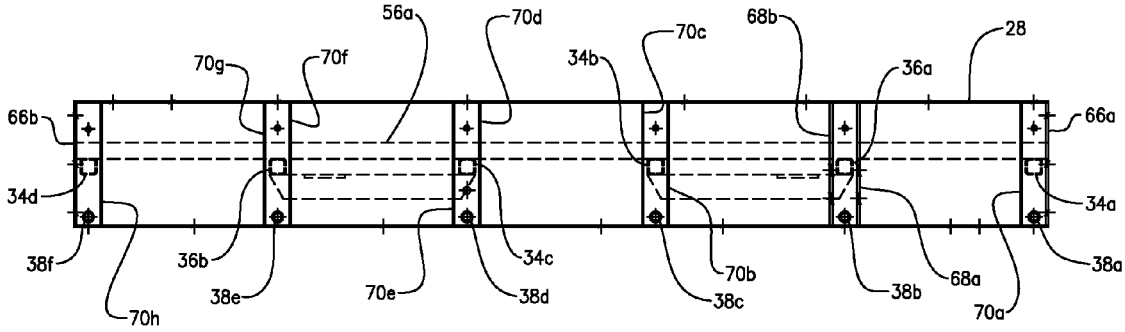

VIBRATING STACKABLE FINE INDUSTRIAL MINERAL HIGH SPEED SCREENING UNIT

FIELD

The present embodiments generally relate to a vibrating stackable fine material high speed screening device that screens particulate by size.

BACKGROUND

A need exists for a high speed screening device that can be installed in a new and/or existing facility and efficiently screen materials to a tight specification at an industrial minerals processing facilities.

A further need exists for a screening device that can make multiple gradation cuts, of particulate simultaneously while creating very little dust in the facility.

A need exists for a device that will prevent human harm during the screening of particulate.

The present embodiments meet these needs.

BRIEF DESCRIPTION OF THE DRAWINGS

The detailed description will be better understood in conjunction with the accompanying drawings as follows:

FIG. 4 is a front view of a screen frame.

FIG. 5 is a different front elevation of a screen frame usable with the screening unit.

FIG. 6A is a top view of a screen frame.

FIG. 6B is a side view of a screen frame.

Figure 1:
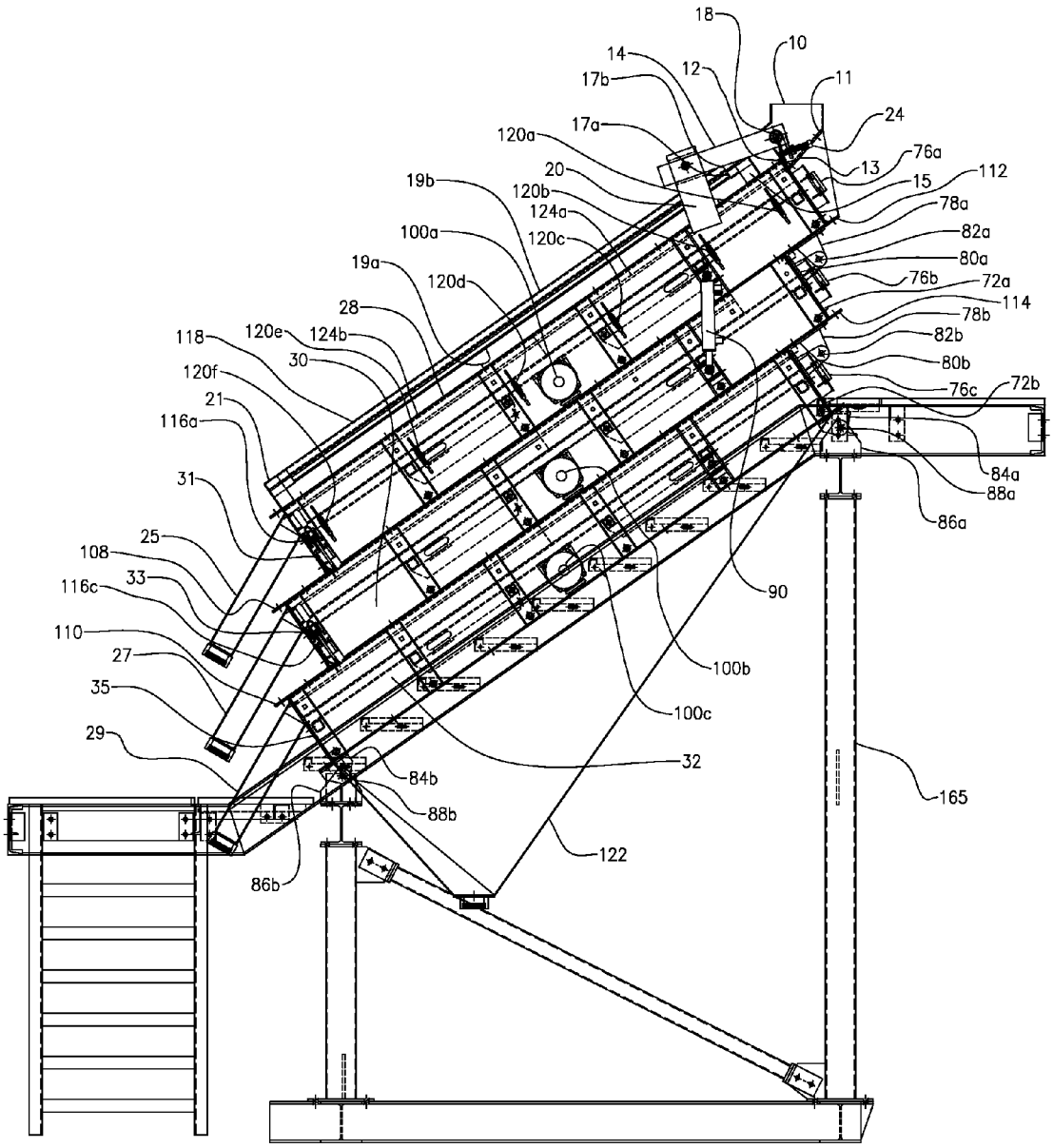
FIG. 1 is a side elevation view of a multi-deck vibrating stackable material screening unit for screening multiple sizes of particulate simultaneously.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to a multi-deck vibrating stackable industrial mineral screening unit.

The screening unit has several benefits, such as it is easy to maintain, it has a screen cloth that can be easily changed, and the invention utilizes few moving parts, essentially only a vibrating assembly moves to screen the mineral particulate.

The present embodiments use a very small, lower power consumption motor. For example, the vibration motor of the invention can use 4 hp to vibrate a group of stacked screen frames simultaneously compared to 60 hp motors used on commercially available units.

The invention is environmentally friendly in that it controls the production of dust in the facility enabling the air of the workers to be more clear of particulate.

The vibrating mineral screening unit can be contemplated to have a modular design, for ease of multiple configurations for different applications.

The invention can be configured to have multiple screen frames that can be stacked at an angle, forming a cascading effect so that not only a vibration motor but gravity can be used to screen industrial particulate in a reduced dust atmosphere.

The embodiments provide fewer lateral forces and fewer extreme motions than currently available screening units. The embodiments add fewer dynamics, such as lower amplitude oscillations to a supporting structure that would hold the screen frames, enabling the supporting structure to be more stable, and of lighter-weight materials, as the stresses on the structure are less as compared with other commercially available units. This embodiments allow a facility owner to increase facility capacity using the existing support structures.

The embodiments enable lighter weight screens to be installed in a facility using high speed oscillations with fewer dynamic forces in an embodiment without changing the support structure.

The units only move the screen cloth in this invention instead of the metal screen frame and accordingly uses less energy, less electricity overall than comparable currently available units.

The supporting structure stays intact better with the lighter vibrational load.

For the multi-stack embodiment, the top screen frame can have a feed inlet.

Each of the screen frames has a discharge spout opposite the feed inlet, a first side wall disposed between the feed inlet and the discharge spout, and a second side wall oriented parallel to and opposite to the first side wall between the feed inlet and the discharge spout.

Each screen frame has a plurality of compression cross members connecting between the first side wall and the second side wall.

A plurality of tension cross members can connect between the first side wall and the second side wall.

A first air manifold cross member can connect between the first side wall and the second side wall proximate to the feed inlet. A second air manifold cross member can connect between the first side wall and the second side wall proximate to the discharge spout.

A plurality of air operated isolation mounts are fixedly attached to the compression cross members using one air operated isolation mount support assembly. The isolation mount support assembly in an embodiment can be made of two stiffeners and a mounting plate disposed between the compression cross members and the air operated isolation mounts.

A plurality of mounting blocks can be used, wherein each mounting block can be fastened to an air operated isolation mount.

A vibrating screen tensioner rests on top of the mounting blocks across the compression members.

The vibrating screen tensioner can have a body, which can be unitary, supporting a vibrator motor, such as an A/C motor with variable vibrations run from a power supply.

The body is disposed over and connected to the mounting blocks over at least two and up to eight compression cross members can be used.

The mounting of the vibrating screen tensioner to the compression cross members, relative to the direction of material flow can enable more efficient screening of the industrial material.

This mounting of the vibrating screen tensioner is parallel to the material flow, which enables better materials stratification, such as enabling fines to travel down the center of the screen cloth and fall through quickly while the larger coarse particulate move to an outer edge of the screen cloth for removal via the discharge spout (still within the screen frame), causing improved screening efficiency.

The body of the vibrating screen tensioner can have a length longer than its width. The length of the body extends from the feed inlet to the discharge spout, wherein the vibrating screen tensioner is in full contact with the screen cloth longitudinally, from feed inlet to discharge spout, and at a right angle to the compression cross members.

An upper cover support extends from the first side wall to the second side wall adjacent the feed inlet. A lower cover support extends from the first side wall to the second side wall adjacent the discharge spout. The cover supports are made from steel, such as coated steel. The dust cover supported by the upper and lower cover supports can be made from a vinyl covered canvas.

A screen cloth is positioned within the screen frame beneath the upper cover support and lower cover support. Each support frame can have a different porosity screen cloth. Screen cloths for example, can be made from woven stainless steel having a porosity that is selected depending on the needs of the customer.

In an embodiment, the screen cloth can be a one (1) layer screen cloth for screening of coarse particulate of about 6 mesh to about 20 mesh. For very fine particulate the screen cloth can have a mesh of about 20 mesh and finer, a second cloth can be used adjacent and in parallel to the first screen cloth, forming a "sandwich cloth" enabling very fine particulate screening in one screen frame.

A first relocatable removable detachable lifting mechanism is secured to the first side and a second relocatable removable detachable lifting mechanism is secured to the second side opposite the first side for raising a first screen frame apart from a second screen frame.

At least two clevis assemblies are bolted in place and removably secured to the first and second sides of a first screen frame. These clevis assemblies are hinged to tang assemblies on the first and second side of a second screen frame. The clevis and tang assemblies moveably hold the first screen frame to the second screen frame.

The vibrator motor in each screen frame vibrates allowing particulate sized to fall through the screen cloth of the first screen frame to the second screen frame while simultaneously discharging a predetermined diameter particulate through the discharge plate connected to a discharge spout to a hopper, a conveyor or another storage unit.

An embodiment can contemplate that vibrator motors are in communication with a motor controller.

Another embodiment can contemplate that the vibrating screen tensioner can be a generally rectangular body with a pair of central perforations, a pair of end perforations and a pair of end cut outs. The end cut outs form a first, second, third and fourth rib extension for the tensioner.

The tensioner's generally rectangular body has a first flange connected to a first rib, a second flange connected to a second rib. The first and second ribs can be parallel to each other and are connected by a generally planar connecting segment.

The pair of central perforations are elliptoid and the pair of end perforations are parabolas and the end cut outs can be generally U-shaped in an embodiment.

The first and second relocatable removable detachable lifting mechanism are hydraulic in an embodiment, but can be mechanical if run by an electric motor, and possibly pneumatic.

The first and second relocatable removable detachable lifting mechanisms in an embodiment, are fluidly connected to a hydraulic reservoir via a control valve with a hydraulic pump enabling the lifting mechanisms to raise at least one screen frame when hydraulic fluid is pumped to the lifting mechanisms.

The term "deck" is used herein to also refer to the assembled screen frames with vibrating screen tensioners, motors, and other equipment described herein.

When assembling a multi-deck assembly, a first screen frame is positioned on another screen frame and the first screen frame has a feed inlet can be operated by a balance gate that opens and closes using a first balance gate arm with a first counter weight connected to a second balance gate arm with a second counter weight with a balance gate axle.

A plurality of longitudinal supports can be used to hold each screen cloth into each screen frame.

The balance gate can have on one or more segments of the balance gate, an abrasion resistant liner, or an impact resistant friction resistant liner or both, such as two layers of materials each providing a unique property. Liners can be made from graphite composite, or a Teflon™, ultra high molecular weight polyethylene, (known commonly in the industry as "UHMW") or other material that encourages sliding and abrasion resistance to industrial minerals, such as particulate of mixed diameters, into the screen frame.

A dust collection tap can be used for removing dust from a screen frame prior to ejecting particulate from a discharge spout of each screen frame to a dust collection system, which can provide a light suction to the interior of each screen frame.

An air manifold can be used to provide compressed air from an air supply to the first and second air manifold cross members which supply air to each of the air operated isolation mounts, simultaneously.

The air operated isolation mounts can each be supported by a mounting plate, a first stiffener and a second stiffener between adjacent pairs of compression cross members as mentioned earlier, however the three components can be a one piece unit.

In an embodiment, an inspection/sampling port can be formed in the screen frame and has a closable inspection/sampling port door in the screen frame adjacent the feed inlet. The door and port can also be in another location, such as an upper end of each screen frame or in each discharge spout of each screen frame. In addition to using the port and door for viewing, test samples can be taken through the port to see the effectiveness of the screening.

The single support frame or multi-deck stackable screen frame unit can be supported on a support stand such as one made from carbon steel. Support frame can be a truck or a trailer, such as a flatbed trailer or a drop deck trailer. The support frame can be a barge.

An embodiment can contemplate that the plurality of screen decks can be mounted to the top of a storage silo for ease of particulate sorting and storage without the use of explosive conveying.

Additionally, a latch assembly can be used to securely latch the first screen frame to the second screen frame and the second screen frame to a third screen frame. Multiple latches can be used to ensure a more dust free environment.

A dust cover can be usable for covering over the upper and lower cover supports. A dust cover latch can secure the dust cover to the screen frame with a plurality of dust cover latches, such as at least 4 latches and up to 20 latches can be used to ensure a safe environment for the workers.

An embodiment can contemplate that a plurality of screen cloth tension bars disposed parallel to each first side and each second side above the screen cloth for providing primary tension to the screen cloth.

The screening unit has a fines hopper connected to the screen frame for collecting fine particulate during operation, wherein the fine particulate has a diameter less than the lowermost screen cloth.

Additionally, a first screen frame transition plate can be mounted to an upper screen frame for engaging a lower screen frame. The transition plates provide a sealed environment between the upper screen frame and the lower screen frame, in a staggered relationship. This staggered relationship between the screen frames enables material that comes through the screen cloth from the upper screen deck to enjoy the full benefit of the lower screen deck operation.

Additionally, a screen cloth tensioner bar for tensioning the screen, can be used. The tensioner bar has an upper stiffener leg, an upper leg connected to the upper stiffener leg at a 90 degree angle, a face plate connected to the upper leg at an angle between 100 degrees to 120 degrees, a lower leg connected to the face plate at a 90 degree angle. A tensioner bolt extends through the face plate to engage a side of the support frame. The lower leg engages a hook strip formed in the edge of a screen cloth.

Another embodiment can contemplate that the screen frame assembly can use a single screen frame with the features described above.

In one or more embodiments an inspection/sampling port with closable inspection/sampling port door can be mounted to the feed inlet. The closable inspection/sampling port door can further be made of a sealable durable elastomeric material, a steel, an aluminum or other material.

Turning now to the Figures, FIG. 1 is a side elevation view of a multi-deck vibrating stackable material screening unit.

In FIG. 1, a first screen frame 28 is disposed on a second screen frame 30. The second screen frame is disposed on a third screen frame 32.

Each of the screen frames has a discharge plate. The upper screen frame has upper screen discharge plate 31, the middle screen frame has a middle screen discharge plate 33, and the bottom screen has a bottom screen discharge plate 35.

Each discharge plate is shown connected to a discharge spout 25, 27, 29 for passing particles of a predetermined size from each of the screen frames to a hopper, a conveyor or another storage or transport unit.

Each discharge spout of a multi-deck unit will flow a different particle size from the other discharge spouts. For example, particles from the top discharge spout 25 can have a diameter between −10 mesh to +20 mesh, while particles from the middle discharge spout 27 have a diameter between −20 mesh to +30 mesh and particles from the bottom discharge spout 29 have a diameter between −30 mesh to +40 mesh.

In this Figure, the first screen frame 28 has a feed inlet 10, which also has a balance gate 12. The balance gate 12 can be operated by two balance gate arms, balance gate arm 14 is shown. The balance gate arms each have a balance gate counter weight. Balance gate counter weight 20 is shown for balance gate arm 14. The balance gate arms are pivoted on a balance gate axle 18.

The feed inlet 10 can have a liner 11 for longer life for the feed inlet. The liner can be an abrasion resistant liner.

The balance gate has a balance gate stop 24. The balance gate stop can be an adjustment bolt with a nut on a fabricated bracket for limiting the travel of the balance gate opening to spread the particulate mix over the full width of the screen cloth.

An upper cover support 15, in an embodiment, can be fabricated into the feed inlet. A lower cover support 21 is also shown connected to the frame.

The dust cover is also shown, supported by cover support holders 17*a*, 17*b*, but additional cover support holders can also be used. Longitudinal supports 19*a*,19*b* fit into the cover support holders. The longitudinal supports can be tubing that can have an outer diameter of between about 1 inch to about 1.5 inch square tubing.

End cover plates 108, 110 are shown enabling the support frames to stack in a staggered manner on each other.

Also shown in FIG. 1 is a first relocatable removable detachable lifting mechanism 90, which in this embodiment is shown as a hydraulic cylinder with piston rod that can be used to lift a first support frame above a second support frame for maintenance.

The first and second screen frames can be connected with latches 116*a*, 116*c* which can be ones made by Destaco™ of the USA.

The screening unit is shown supported on a frame 165 allowing the screen frames to be inclined rather than flat for allowing gravity to facilitate conveying particles down the screen cloth using less electricity than flat based units.

The first screen frame 28, is further shown with an inspection/sampling port door 76*a*, second screen frame 30 has inspection/sampling port door 76*b*, and third screen frame 32 has inspection/sampling port door 76*c*.

Also depicted in this Figure is fines hopper 122, the dust cover latch assemblies 120*a*, 120*b*, 120*c*, 120*d*, 120*e*, 120*f* and the dust cover 118.

Also shown in FIG. 1 is the balance gate liner 13 for the balance gate 12. The balance gate liner can be made of the same material and can have the same thicknesses as the feed inlet liner.

A first screen frame transition plate 112 is depicted between the first and second deck.

It can be noted that deck to deck, the latches 116*a*, 116*c* can hold the decks together.

FIG. 1 additionally shows two of the clevis assembly 78*a*, 78*b* which connect to the tang assembly 80*a*, 80*b* in a rotating or hinged construction.

FIG. 1 shows the receiver end plates 72*a*, 72*b*, which are also usable herein. Frame mounts are shown as frame mount tops 84*a*, 84*b*. Frame mount bottoms 86*a*, 86*b*, frame mount pins 88*a*, 88*b* and pins 82*a*, 82*b* are also depicted.

Screen cloth tensioner bars 124*a*, 124*b* that apply tension to the hook strip of the screen cloth are shown.

Vibrator motors 100*a*, 100*b*, 100*c* which attach to the vibrating screen tensioner are also shown.

Figure 2:
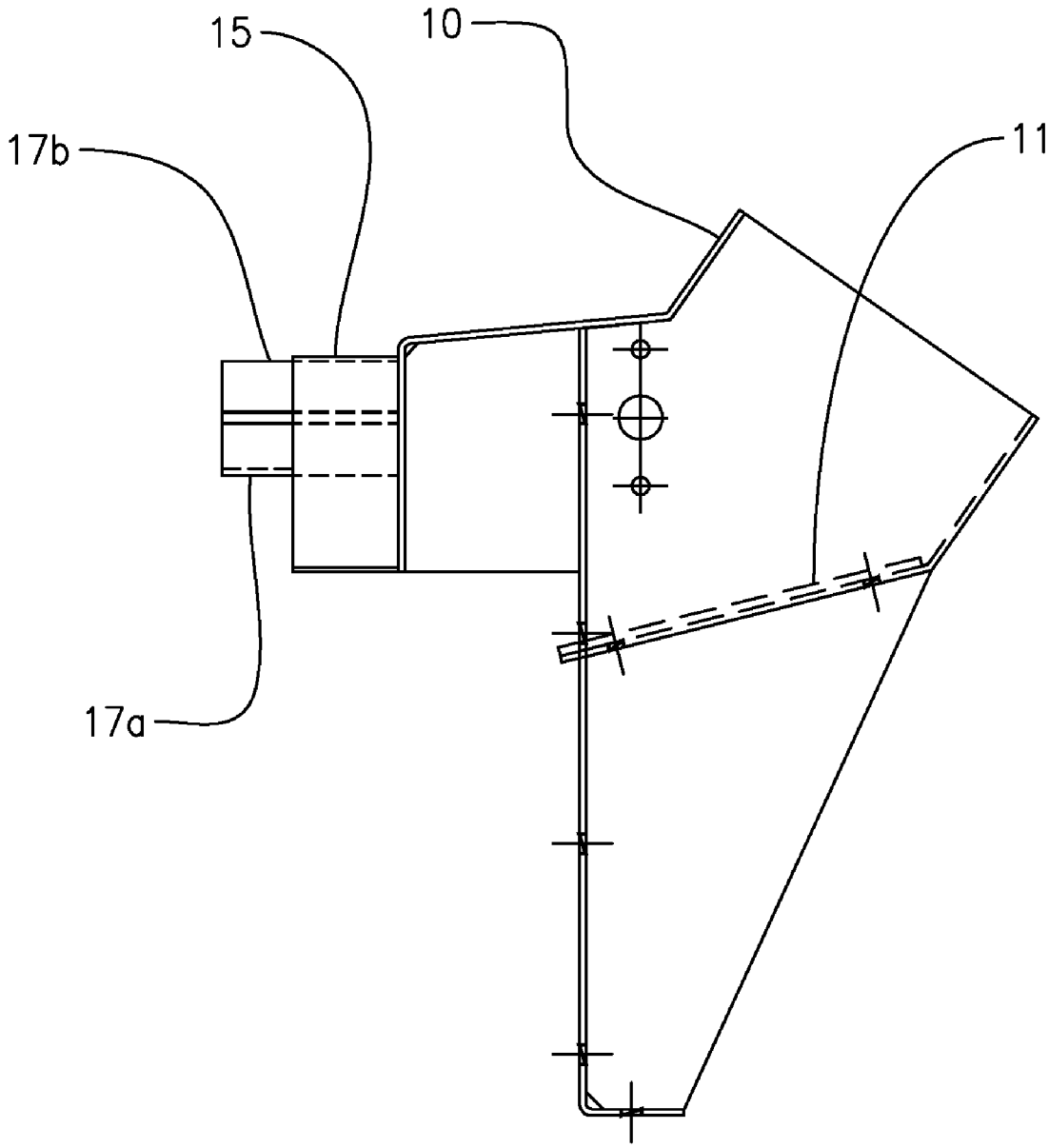
FIG. 2 is a detail of a feed inlet with a liner usable in the screening unit.

FIG. 2 shows a detail of the feed inlet 10 having a liner 11. The liner can be a liner on the bottom of the feed inlet or on the side of the feed inlet, or on all sides and bottom of the feed inlet. The liner can be made of a ceramic/glass composite. The thickness of the liner can range from about 0.125 inch to about 1 inch.

FIG. 2 also shows the upper cover support 15 and the cover support holders 17*a*, 17*b*.

Figure 3:
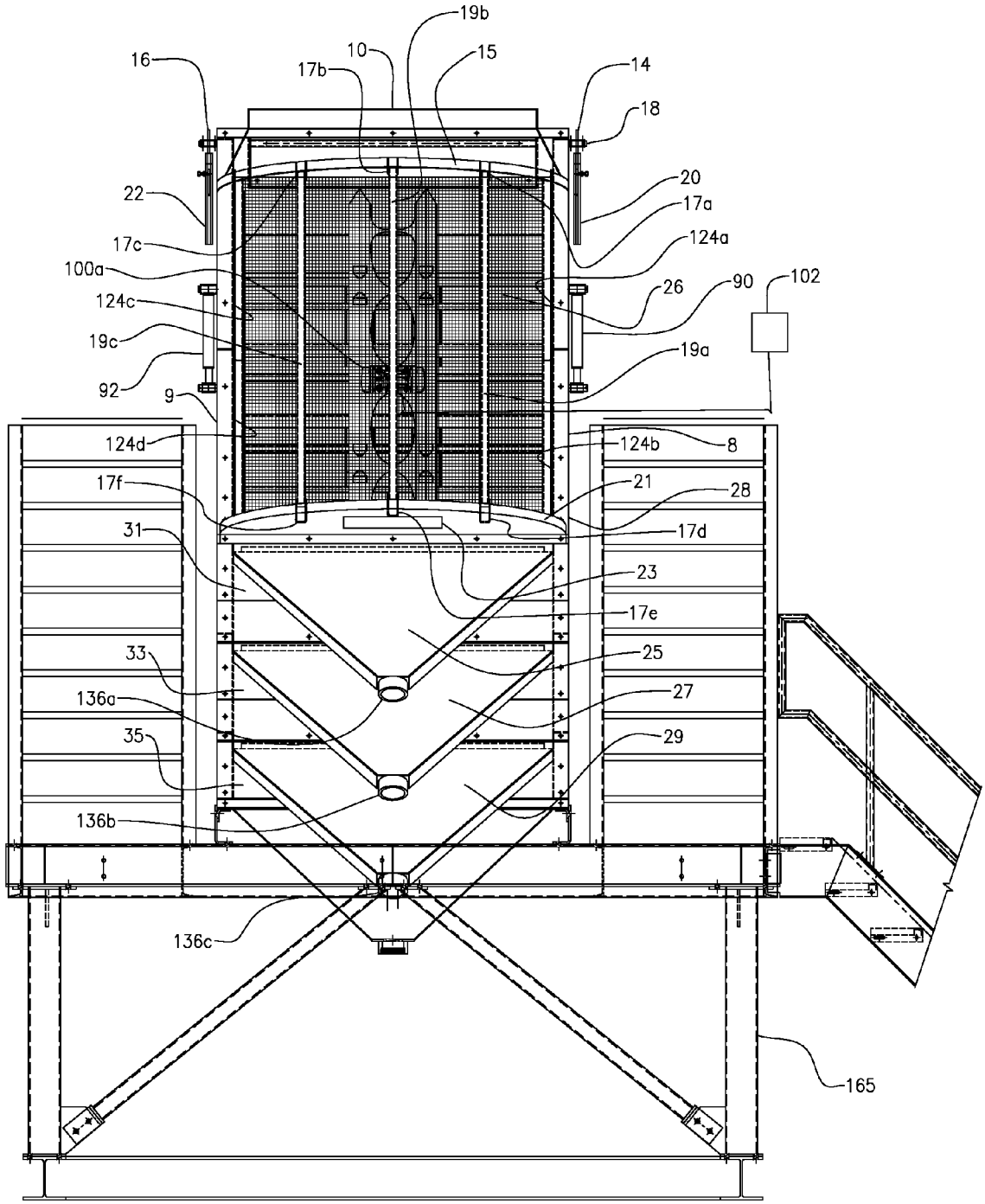
FIG. 3 is a front elevation of an embodiment of the multi-deck vibrating stackable material screening unit.

FIG. 3 shows the support frame sides 8, 9. Within the support frame sides, vibrator motor 100*a* for the screen frame is shown.

FIG. 3 also shows a front elevation of the multi-deck of FIG. 1 and further depicts the balance gate arms 14, 16 connected by the balance gate axle 18 between the arms. A bearing can be used on each side of the balance gate axle.

The balance gate counterweights 20, 22 are also shown. Discharge spouts 25, 27, 29 are also shown more clearly in this Figure. Each discharge spout in FIG. 3 has a coupling 136*a*, 136*b*, 136*c* for engaging a fitting that attaches to a hose for removing the sized particulate.

FIG. 3 has a first relocatable removable detachable lifting mechanism 90 and a second relocatable removable detachable lifting mechanism 92, which can be hydraulic.

Also shown in FIG. 3 are feed inlet 10, upper cover support 15, cover support holders 17*a*, 17*b*, 17*c* as well as cover support holders 17*d*, 17*e*, 17*f*. Longitudinal supports 19*a*, 19*b*, 19*c* are also shown and can be inserted into the cover support holders. Longitudinal support covers can be used to support the dust cover, which is not shown in this embodiment.

Also shown is the dust collection tap 23 for flowing dust from under the dust cover to a container to prevent explosions from the dust. Dust can be extremely explosive in a contained space, and the tap, prevents explosions. The invention provides safer air for employees and can help prevent silicosis, which is a form of occupational lung disease caused by inhalation of crystalline silica dust FIG. 3 also shows first screen frame 28 with the screen cloth 26 in the frame.

Screen discharge plates 31, 33, 35 are also depicted which can be $3/16^{th}$ inch in thickness, that are about 5 foot 6 inches wide and about 16 inches high for transitioning the end of the screen deck to a discharge spout.

Screen cloth tension bars 124*a*, 124*b*, 124*c*, 124*d* hold the screen cloth to the screen frame.

The vibration motor of each screen frame can be in communication and can be controlled by a motor controller 102, which can also be centralized.

The stacked assembly is shown on the support frame 165.

FIG. 3 has the upper cover support 15 and the lower cover support 21 which in this embodiment are arched for supporting the dust cover and preventing dust from escaping the screen frame into the air near the unit. The dust cover prevents harm to the operators of the unit.

FIG. 4 shows an air supply 55 to the middle of the screen frame. An air supply 57 to the top screen of the screen frame is also shown.

A receiver end plate 72*b* of the lower deck, or bottom deck is depicted in this Figure.

Also shown is an inspection/sampling port 74, which can be sealable and can further be located in the lower screen frame with inspection/sampling port door 76*c*.

FIG. 4 further shows an air manifold 40 connected to an air regulator 42 which engages an air source 44 that can be a compressed air source. The air manifold connects to first and second air manifold cross members, which are better depicted in FIG. 6B, and allows for simultaneous inflation of air operated isolation mounts. The third screen frame 32 and the air tube 50 from the air manifold cross member are also depicted.

FIG. 5 shows a cross sectional elevation of the first screen frame 28. In this Figure the compression cross member 34*a* can be seen positioned above the tension cross member 38*a*. A first screen cloth base support 56*a* is shown as well as a second screen cloth base support 56*b*. End plates 66*b*, 66*d* are shown.

FIG. 6A is a top view of the first screen frame 28. This Figure shows the compression cross members 34*a*, 34*b*, 34*c*, 34*d*. Also shown are screen cloth base supports 56*a*, 56*b*.

End plates 66*a*, 66*b*, 66*c*,66*d* for the screen frame are shown. Up to 4 end plates can be used for each screen frame. Additional stiffeners can be used in the screen frame, including cylinder mount stiffeners, 68*a*, 68*b*, 68*c*, 68*d*, which are also shown and up to four can be used per screen frame. Frame stiffeners 70*a*, 70*b*, 70*c*, 70*d*, 70*e*, 70*f*, 70*g*, and 70*h* are shown and up to 16 can be used per screen frame.

The mounting plate 60 and its associated first stiffener 62 and second stiffener 64 are also shown.

Figure 7:
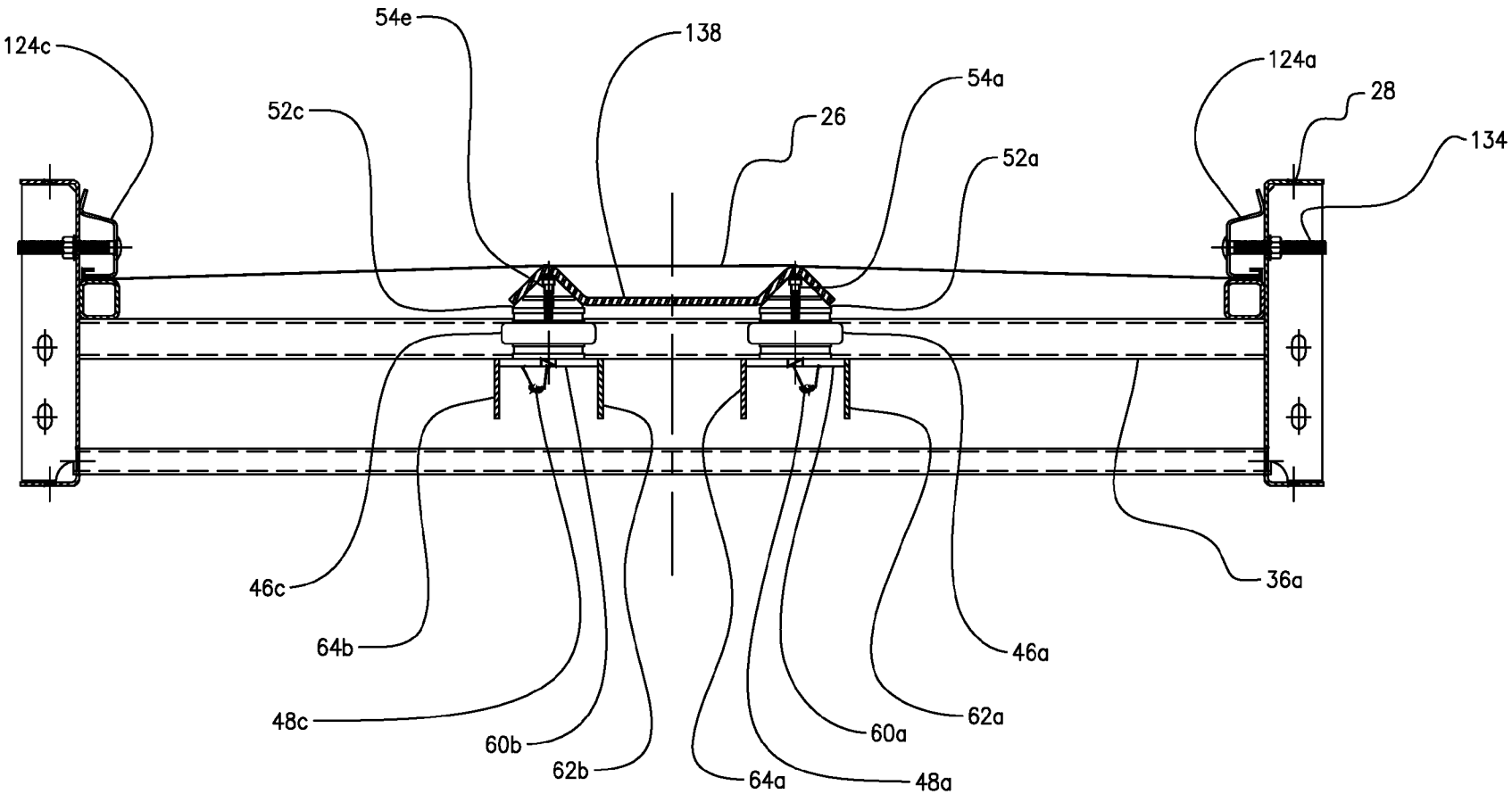
FIG. 7 depicts an air operated isolation mount.

Mounted to the mounts shown in FIG. 6A are the air operated isolation mounts provided in detail in FIG. 7.

FIG. 6B is a side view of first screen frame 28 and depicts the tension cross members 38*a*, 38*b*, 38*c*, 38*d*, 38*e*, 38*f*. Also shown are the first and second air manifold cross members 36*a*, 36*b* that supply air to air operated isolation mounts that are depicted in a later Figure.

FIG. 6B shows compression cross members 34*a*, 34*b*, 34*c*, 34*d* and the frame stiffeners 70*a*, 70*b*, 70*c*, 70*d*, 70*e*, 70*f*, 70*g*, 70*h* are also depicted. The first screen cloth base support 56*a*, cylinder mount stiffeners 68*a*, 68*b* and end plates 66*a*, 66*b* are also depicted.

FIG. 7 shows the screen cloth 26 in first screen frame 28 and the first air manifold cross members 36*a*.

A first and second tube 48*a*, 48*c* provide air from the air manifold cross member to each air operated isolation mount.

FIG. 7 also depicts an air operated isolation mounts 46*a*, 46*c* connected to mounting blocks 52*a*, 52*c*. The mounting blocks can each be made of a phenolic compound. The mounting can be accomplished using isolation mount fasteners 54*a*, 54*e*, which can be threaded in an embodiment.

Two mounting plates 60*a*, 60*b* are also shown each having a first stiffener 62*a*, 62*b*. A second set of stiffeners 64*a*, 64*b*.

Screen cloth tension bars 124*a*, 124*c* are shown for tensioning the screen cloth. A tensioning bolt 134 and the vibrating screen tensioner 138 are also depicted.

Figure 8A:
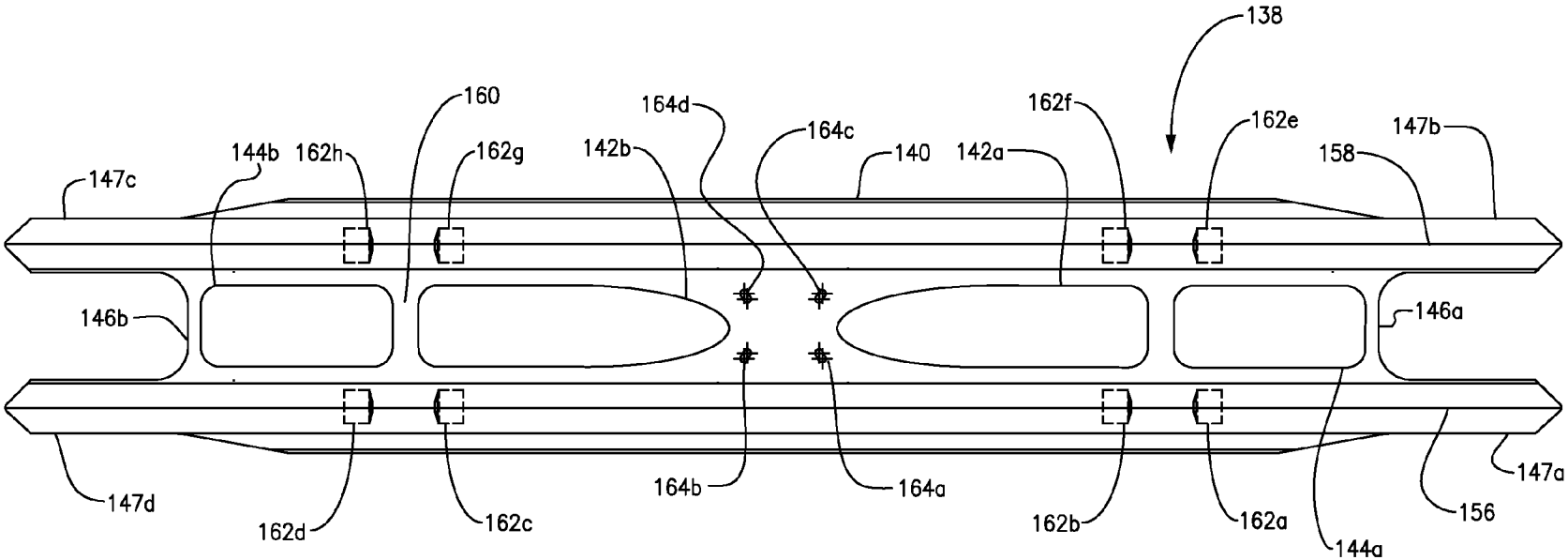
FIG. 8A is a top view of a vibrating screen tensioner usable in the screen frame.

FIG. 8A is a top view of a vibrating screen tensioner usable herein.

The vibrating screen tensioner 138 can have a body 140, which can be unitary, and rectangular, with a pair of central perforations 142*a*, 142*b*, a pair of end perforations 144*a*, 144*b* and a pair of end cut outs 146*a*, 146*b*. The end cut outs form rib extensions 147*a*, 147*b*, 147*c*, 147*d*.

Clips 162*a*, 162*b*, 162*c*, 162*d*, 162*e*, 162*f*, 162*g*, 162*h* are shown for holding the ribs to mounting blocks in the screen frame.

Mounting holes 164*a*, 164*b*, 164*c*, 164*d* for mounting fasteners are shown for holding the vibration motor to the vibrating screen tensioner. A slotted hole can be used herein enabling the mounting of many different vibrator motors into one assembly.

A first rib 156 is shown as well as second rib 158 with the connecting segment 160.

Figure 8B:
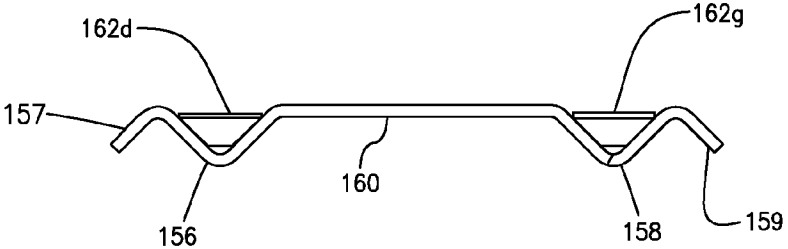
FIG. 8B is a side view of the vibrating screen tensioner.

FIG. 8B is a side view of a vibrating screen tensioner 158 having a first flange 157 connected to a first rib 156. A second flange 159 is connected to a second rib 158. A connecting segment 160, which can be generally planar, connects the first rib with the second rib. Clips 162*d* and 162*g* are also shown.

The first and second ribs rise above the connected segment, to an elevation of between about 1 inch to about 3 inches in a generally triangular construction.

Figure 9:
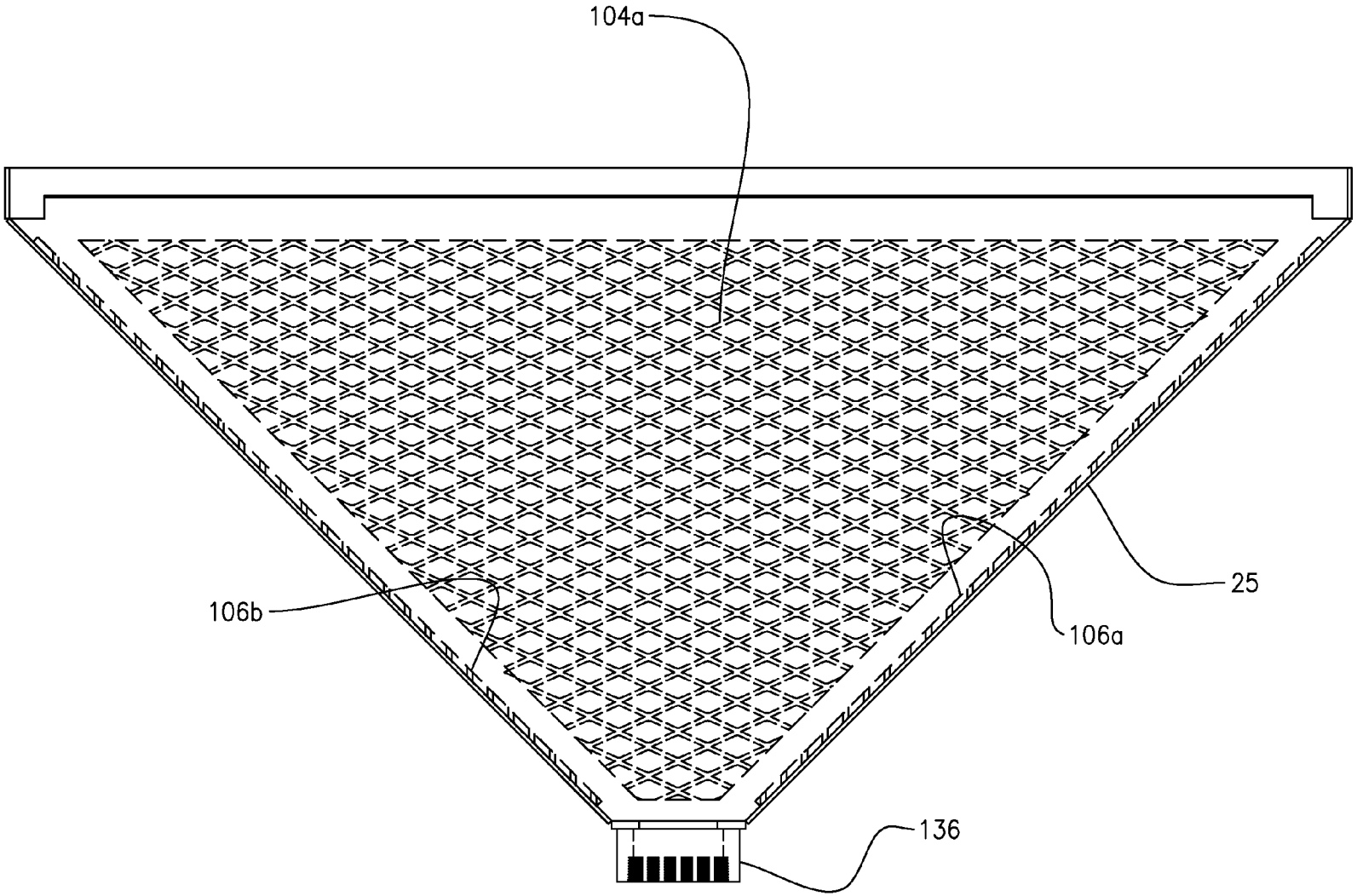
FIG. 9 is a plan view of a discharge spout with liner from the screen frame.

FIG. 9 is a detail of a discharge spout 25 with discharge spout liner. In this embodiment is shown a top discharge spout liner 104*a*, a first discharge spout side 106*a* and a second discharge spout side 106*b*. A second top discharge spout liner is not shown in this Figure. A half coupling 136 for coupling the spout to a hose is also shown.

Figure 10:
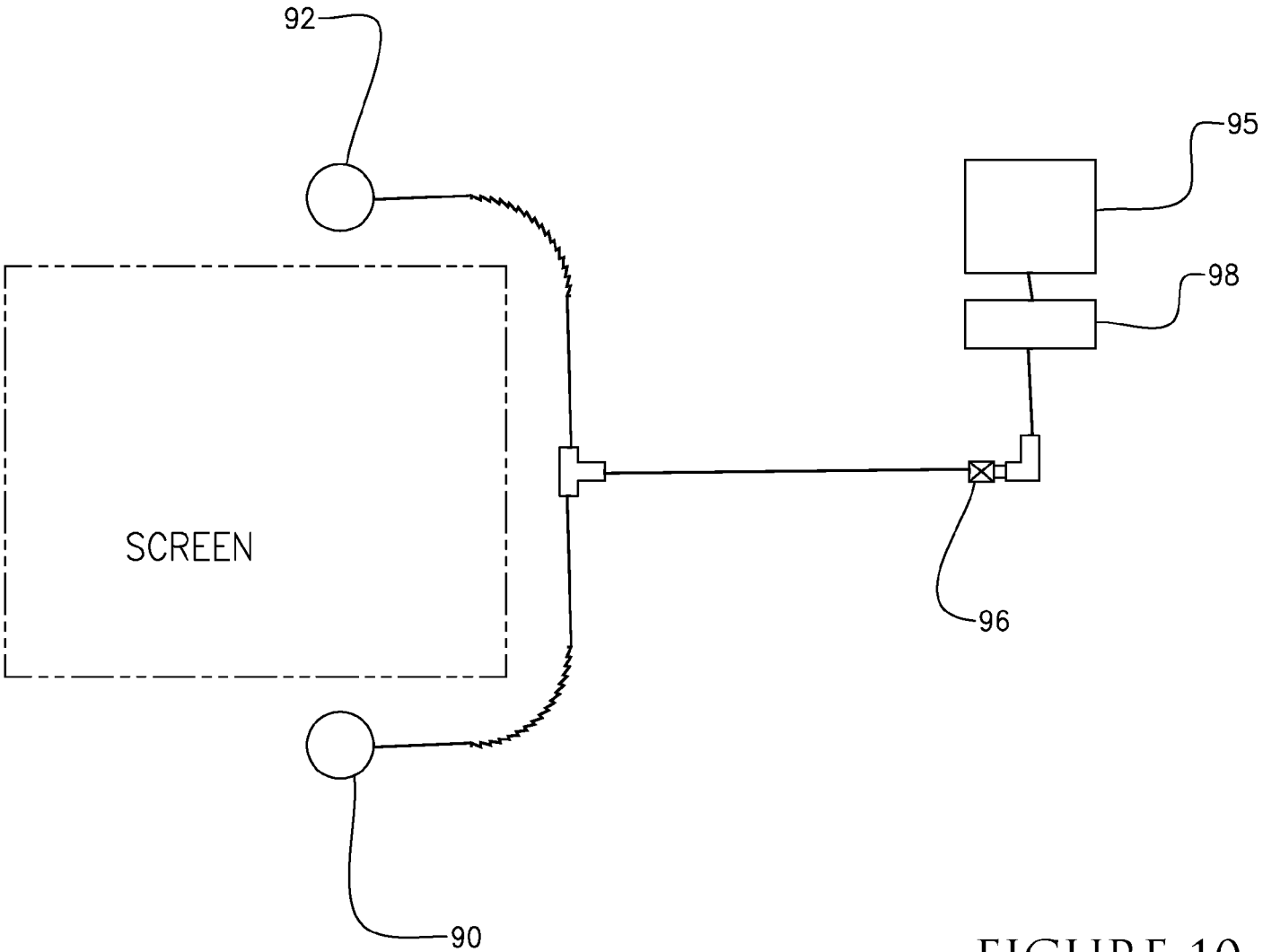
FIG. 10 is a diagram of a hydraulic system configuration usable in the invention.

FIG. 10 shows a diagram of a hydraulic configuration of the first and second relocatable removable detachable lifting mechanisms 90, 92, which can be hydraulic cylinders, connected between screen frames connected to a control valve 96 and a hydraulic pump 98 connected to a hydraulic reservoir 95.

Figure 11:
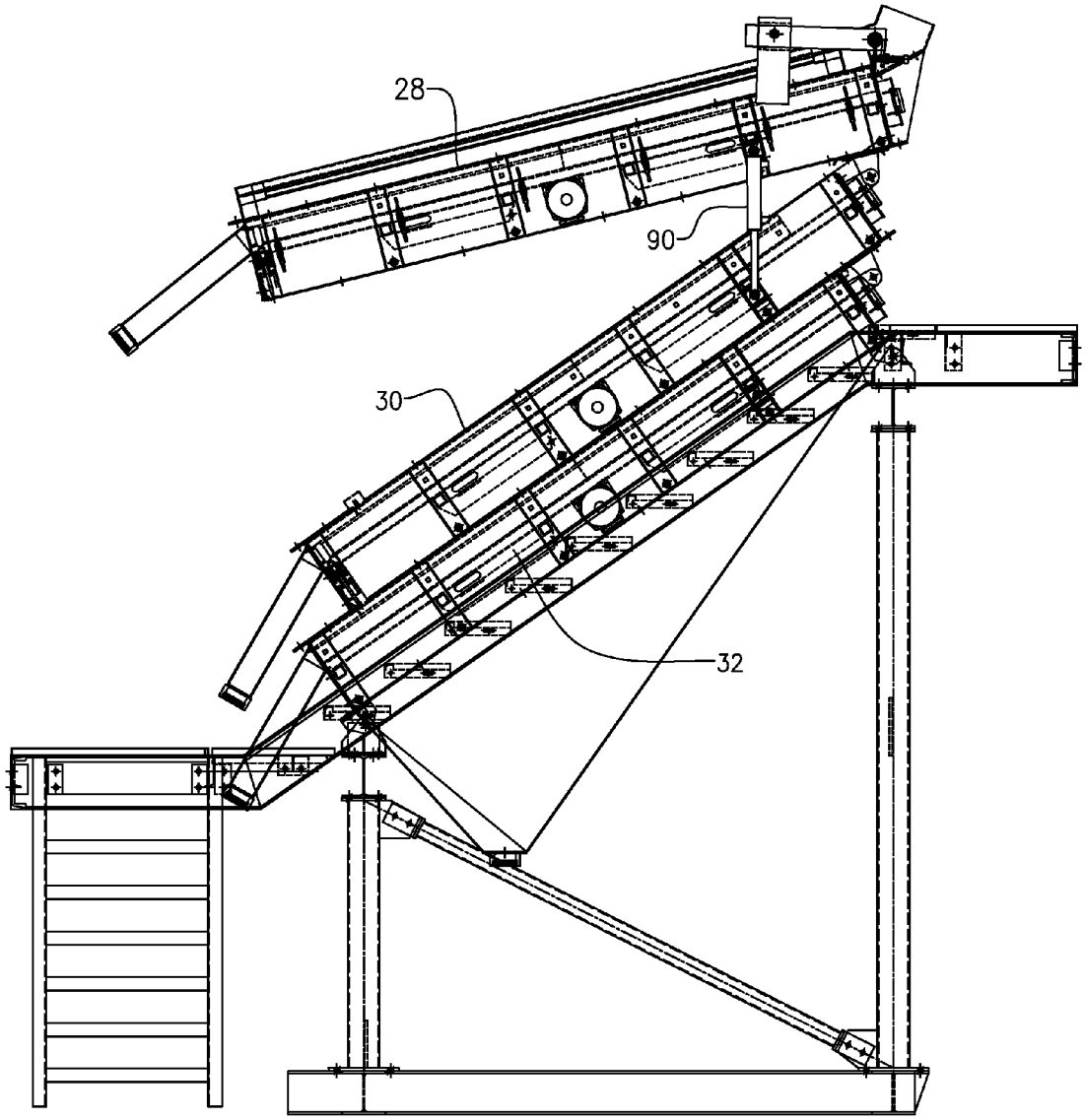
FIG. 11 is a detail of a multi-stacked screening unit.

FIG. 11 shows a first screen frame 28 held apart from second screen frame 30 using a first relocatable removable detachable lifting mechanism 90 while sitting on the third screen 32.

Figure 12:
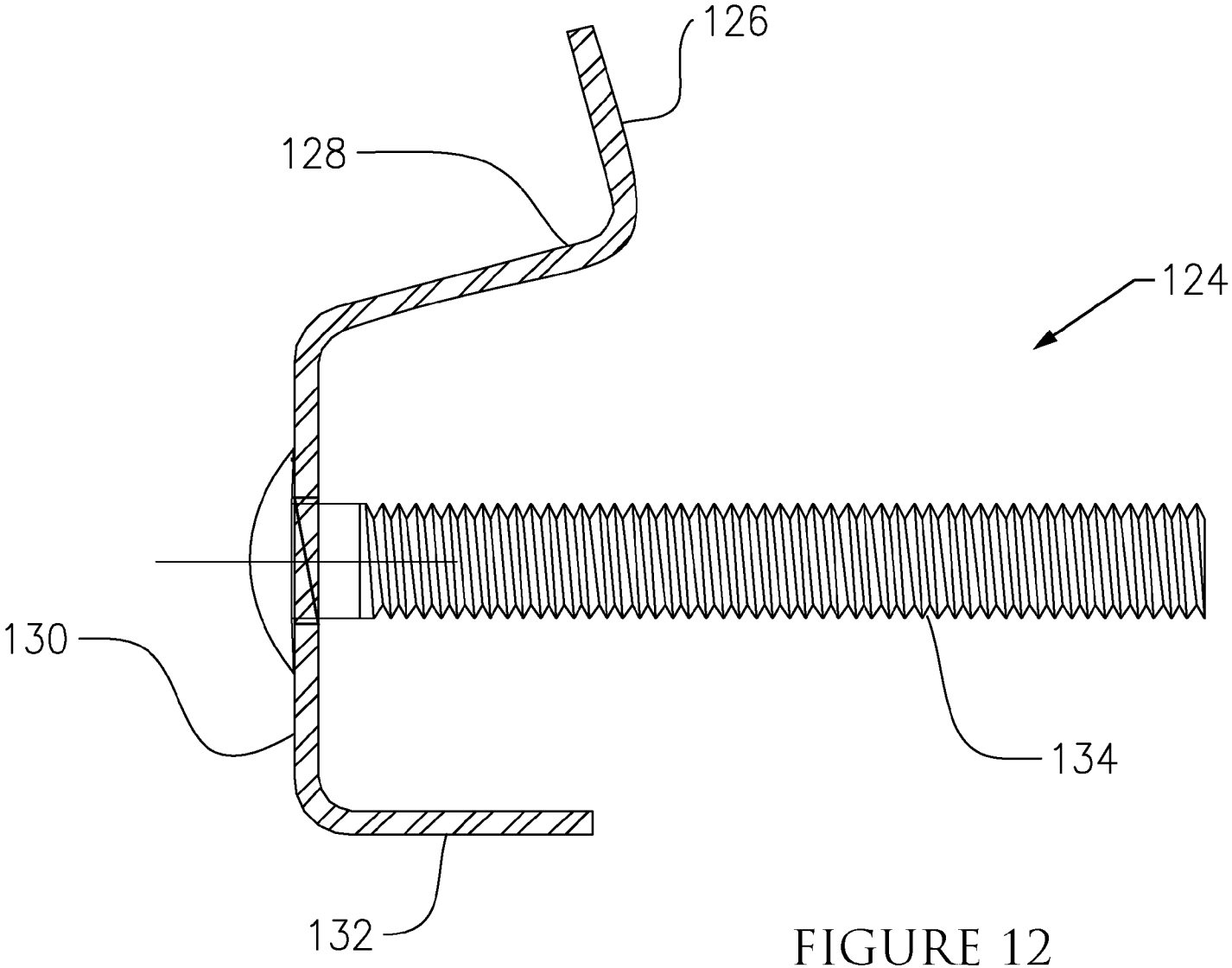
FIG. 12 is a side view of a screen cloth tension bar usable herein.

FIG. 12 shows a side view of a screen cloth tension bar 124. The screen cloth tension bar has an upper stiffener leg 126 connected to an upper leg 128. A face plate 130 engages the upper leg 128. A lower leg 132 engages the face plate 130. A tensioning bolt 134 passes through the face plate 130 for tensioning as a bent plate.

While these embodiments have been described with emphasis on the embodiments, it should be understood that within the scope of the appended claims, the embodiments might be practiced other than as specifically described herein.

What is claimed is:

1. A multi-deck vibrating stackable material screening unit comprising:

a. a plurality of screen frames, wherein each screen frame comprises:
   (i) a feed inlet;
   (ii) a discharge spout opposite the feed inlet;
   (iii) a first side wall disposed between the feed inlet and the discharge spout;
   (iv) a second side wall oriented parallel to and opposite to the first side wall between the feed inlet and the discharge spout;
   (v) a plurality of compression cross members connecting between the first side wall and the second side wall;
   (vi) a plurality of tension cross members connecting between the first side wall and the second side wall;
   (vii) a first air manifold cross member connecting between the first side wall and the second side wall proximate to the feed inlet; and
   (viii) a second air manifold cross member connecting between the first side wall and the second side wall proximate to the discharge spout;

b. a plurality of air operated isolation mounts, wherein two air operated isolation mounts are each disposed on one of the compression cross members;

c. a plurality of mounting blocks, wherein each mounting block is fastened to one of the air operated isolation mounts;

d. a vibrating screen tensioner for each screen frame comprising at least two ribs connected to one another by a body, wherein a first flange is connected to one of the at least two ribs and a second flange is connected to the other of the at least two ribs, wherein the body comprises at least one perforation, wherein a vibrator motor is connected to the body, wherein the vibrating screen tensioner is disposed over and connected to the mounting blocks over all compression cross members, wherein the body has a length longer than its width and the length extends from the feed inlet to the discharge spout, and wherein the vibrating screen tensioner is parallel to a direction of material flow;

e. an upper cover support extending from the first side wall to the second side wall adjacent the feed inlet for each screen frame;

f. a lower cover support extending from the first side wall to the second side wall adjacent the discharge spout for each screen frame;

g. a screen cloth disposed within each screen frame beneath the upper and lower cover supports;

h. a first relocatable removable detachable lifting mechanism secured to the first side wall and a second relocatable removable detachable lifting mechanism secured to the second side wall opposite the first side wall for raising a first screen frame of the plurality of screen frames apart from a second screen frame of the plurality of screen frames; and i. at least two clevis assemblies disposed on the first and second sides walls of the first screen frame for hingedly connecting to at least two tang assemblies on a first and second side walls of the second screen frame for holding the first screen frame to the second screen frame, wherein the vibrator motor in each screen frame vibrates allowing particulate sized to fall through the screen cloth of the first screen frame to the second screen frame, while discharging a predetermined diameter particulate through the discharge spout to a discharge hopper.

2. The multi-deck vibrating stackable material screening unit of claim 1, wherein the vibrator motors are in communication with a motor controller.

3. The multi-deck vibrating stackable material screening unit of claim 1, wherein the body of the vibrating screen tensioner comprises a pair of central perforations, a pair of end perforations and a pair of end cut outs, and wherein the end cut outs form a first, second, third and fourth rib extension.

4. The multi-deck vibrating stackable material screening unit of claim 3, wherein the first and second rib extensions are disposed parallel to each other and connected by a generally planar connecting segment.

5. The multi-deck vibrating stackable material screening unit of claim 3, wherein the pair of central perforations are at least one of parabolic at one end and flat with radius curves at the other end, wherein the ends are connected by a straight portion or rectangular with radius corners at each end, and wherein the end cut outs are generally C-shaped.

6. The multi-deck vibrating stackable material screening unit of claim 1, wherein the first and second relocatable removable detachable lifting mechanisms are hydraulic.

7. The multi-deck vibrating stackable material screening unit of claim 6, wherein the first and second relocatable removable detachable lifting mechanisms are fluidly connected to a hydraulic reservoir via a control valve with a hydraulic pump enabling the relocatable removable detachable lifting mechanisms to raise at least one screen frame when hydraulic fluid is pumped to the relocatable removable detachable lifting mechanisms.

8. The multi-deck vibrating stackable material screening unit of claim 1, wherein the feed inlet is operated by a balance gate that opens and closes using a first balance gate arm with a first counter weight connected to a second balance gate arm with a second counter weight with a balance gate axle.

9. The multi-deck vibrating stackable material screen unit of claim 1, further comprising a plurality of longitudinal supports for supporting the screen cloth in the screen frame.

10. The multi-deck vibrating stackable material screening unit of claim 8, wherein the balance gate comprises a liner, which is impact and friction resistant.

11. The multi-deck vibrating stackable material screening unit of claim 1, further comprising a dust collection tap for removing dust from a screen frame prior to ejecting particulate from the discharge spout.

12. The multi-deck vibrating stackable material screening unit of claim 1, further comprising an air manifold for providing compressed air from an air supply to the first and second air manifold cross members which supply air to each of the air operated isolation mounts simultaneously.

13. The multi-deck vibrating stackable material screening unit of claim 1, wherein each air operated isolation mount is supported by a mounting plate, a first stiffener and a second stiffener, between adjacent pairs of compression cross members.

14. The multi-deck vibrating stackable material screening unit of claim 1, further comprising an inspection/sampling port with a closable inspection/sampling port door in the screen frame adjacent the feed inlet.

15. The multi-deck vibrating stackable material screen unit of claim 1, further comprising an inspection/sampling port with a closable inspection/sampling port door mounted to the feed inlet.

16. The multi-deck vibrating stackable material screen unit of claim 15, wherein the closable inspection/sampling port door comprises a durable elastomeric material.

17. The multi-deck vibrating stackable material screening unit of claim 1, wherein the screen frames are supported on a support stand.

18. The multi-deck vibrating stackable material screening unit of claim 1, further comprising a latch assembly for securely latching the first screen frame to the second screen frame.

19. The multi-deck vibrating stackable material screening unit of claim 1, further comprising a dust cover for covering over the upper and lower cover supports and longitudinal supports.

20. The multi-deck vibrating stackable material screening unit of claim 19, further comprising a dust cover latch assembly for securing the dust cover to the screen frame.

21. The multi-deck vibrating stackable material screening unit of claim 1, further comprising a plurality of screen cloth tension bars disposed parallel to each first side wall and each second side wall above the screen cloth for providing tension to the screen cloth.

22. The multi-deck vibrating stackable material screening unit of claim 1, further comprising a fines hopper connected to the one of the screen frames for collecting fine particulate during operation having a diameter smaller than aperture openings of a lower most screen cloth.

23. The multi-deck vibrating stackable material screening unit of claim 1, further comprising a first screen frame transition plate mounted to the first screen frame for engaging the second screen frame.

24. The multi-deck vibrating stackable material screening unit of claim 21, further comprising a tensioner bar for each screen frame for applying a primary tension to each screen cloth, wherein the tensioner bar comprises an upper stiffener leg, an upper leg connected to the upper stiffener leg at a 90 degree angle, a face plate connected to the upper leg at an angle between 100 degrees to 120 degrees, a lower leg connected to the face plate at a 90 degree angle, and wherein a tensioner bolt extends through the face plate to engage the tensioner bar.

25. A vibrating industrial material screening unit comprising:

a. a screen frame comprising:
   (i) a feed inlet;
   (ii) a discharge spout opposite the feed inlet;
   (iii) a first side wall disposed between the feed inlet and the discharge spout;
   (iv) a second side wall oriented parallel to and opposite to the first side wall between the feed inlet and the discharge spout;
   (v) a plurality of compression cross members connecting between the first side wall and the second side wall;
   (vi) a plurality of tension cross members connecting between the first side wall and the second side wall;
   (vii) a first air manifold cross member connecting between the first side wall and the second side wall proximate to the feed inlet; and
   (viii) a second air manifold cross member connecting between the first side wall and the second side wall proximate to the discharge spout;
b. a plurality of air operated isolation mounts, wherein two air operated isolation mounts are each disposed on one of the compression cross members;
c. a plurality of mounting blocks, wherein each mounting block is fastened to one of the air operated isolation mounts;
d. a vibrating screen tensioner comprising at least two ribs connected to one another by a body, wherein a first flange is connected to one of the at least two ribs and a second flange is connected to the other of the at least two ribs, wherein the body comprises at least one perforation, wherein a vibrator motor is connected to the body, wherein the vibrating screen tensioner is disposed over and connected to the mounting blocks over all compression cross members, wherein the body has a length longer than its width and the length extends from the feed inlet to the discharge spout, and wherein the vibrating screen tensioner is parallel to a direction of material flow;
e. an upper cover support extending from the first side wall to the second side wall adjacent the feed inlet;
f. a lower cover support extending from the first side wall to the second side wall adjacent the discharge spout; and
g. a screen cloth disposed within the screen frame beneath the upper and lower cover supports, wherein the vibrator motor vibrates allowing particulate sized to fall through the screen cloth to a first container while discharging particulate with a diameter larger than the screen cloth to flow to the discharge spout to a discharge hopper or other storage or conveying means.

26. The vibrating industrial material screening unit of claim 25, wherein the vibrator motor communicates with a motor controller.

27. The vibrating industrial material screening unit of claim 25, wherein the vibrating screen tensioner comprises a body, which is generally rectangular, with a pair of central perforations, a pair of end perforations and a pair of end cut outs, and wherein the end cut outs form a first, second, third and fourth rib extension.

28. The vibrating industrial material screening unit of claim 27, wherein the first and second ribs extensions are parallel to each other and are connected by a generally planar connecting segment.

29. The vibrating industrial material screening unit of claim 27, wherein the pair of central perforations are at least one of parabolic at one end and flat with radius curves at the other end, wherein the ends are connected by a straight portion or rectangular with radius corners at each end, and wherein the end cut outs are generally C-shaped.

30. The vibrating industrial material screening unit of claim 25, wherein the feed inlet is operated by a balance gate that opens and closes using a first balance gate arm with a first counter weight connected to a second balance gate arm with a second counter weight with a balance gate axle.

31. The vibrating industrial material screening unit of claim 25, further comprising a plurality of longitudinal supports for supporting the screen cover over the screen frame.

32. The vibrating industrial material screening unit of claim 30, wherein the balance gate comprises a liner, which is impact and friction resistant.

33. The vibrating industrial material screening unit of claim 25, further comprising a dust collection tap for removing dust from the screen frame prior to ejecting particulate from the discharge spout.

34. The vibrating industrial material screening unit of claim 25, further comprising an air manifold for providing compressed air from an air supply to the first and second air manifold cross members which supply air to each of the air operated isolation mounts simultaneously.

35. The vibrating industrial material screening unit of claim 25, wherein each air operated isolation mount is supported by a mounting plate, a first stiffener and a second stiffener between adjacent pairs of compression cross members.

36. The vibrating industrial material screening unit of claim 25, further comprising an inspection/sampling port with a closable inspection/sampling port door in the screen frame adjacent the feed inlet.

37. The vibrating industrial material screening unit of claim 25, wherein the screen frames are portable, moveable and relocatable on a transport vehicle.

38. The vibrating industrial material screening unit of claim 25, further comprising a dust cover for covering over the upper and lower cover supports.

39. The vibrating industrial material screening unit of claim 38, further comprising a dust cover latch assembly for securing the dust cover to the screen frame.

40. The vibrating industrial material screening unit of claim 25, further comprising a plurality of screen cloth tension bars disposed parallel to the first side wall and the second side wall above the screen cloth for providing tension to the screen cloth.

41. The vibrating industrial material screening unit of claim 25, further comprising a tensioner bar for applying primary tension to the screen cloth, wherein the tensioner bar comprises an upper stiffener leg, an upper leg connected to the upper stiffener leg at a 90 degree angle, a face plate connected to the upper leg at an angle between 100 degrees to 120 degrees, a lower leg connected to the face plate at a 90 degree angle, and wherein a tensioner bolt extends through the face plate to engage the tension bar.

* * * * *